US008936424B1

(12) United States Patent
Barnes et al.

(10) Patent No.: US 8,936,424 B1
(45) Date of Patent: Jan. 20, 2015

(54) VERTICAL PIPE HANDLER WITH PIVOTING ARMS AND SMART GRIP

(71) Applicant: Loadmaster Universal Rigs, Inc., Houston, TX (US)

(72) Inventors: R. Michael Barnes, Magnolia, TX (US); James A. Zapico, Houston, TX (US)

(73) Assignees: Canyon Oak Energy LLC, Houston, TX (US); Loadmaster Universal Rigs, Inc., Houston, TX (US)

( * ) Notice: Subject to any disclaimer, the term of this patent is extended or adjusted under 35 U.S.C. 154(b) by 0 days.

(21) Appl. No.: 13/679,993

(22) Filed: Nov. 16, 2012

Related U.S. Application Data

(60) Provisional application No. 61/587,512, filed on Jan. 17, 2012.

(51) Int. Cl.
*E21B 19/00* (2006.01)
*B66F 11/00* (2006.01)
*E21B 19/02* (2006.01)

(52) U.S. Cl.
CPC *E21B 19/02* (2013.01); *B66F 11/00* (2013.01)
USPC ..... 414/22.63; 414/745.2; 414/746.3

(58) Field of Classification Search
USPC ..... 414/22.51–22.71, 910, 911, 745.2, 414/745.6, 746.8, 746.3, 618, 663, 665
See application file for complete search history.

(56) References Cited

U.S. PATENT DOCUMENTS

| | | | | | |
|---|---|---|---|---|---|
| 4,042,123 | A * | 8/1977 | Sheldon et al. | ..... | 414/22.71 |
| 4,077,525 | A * | 3/1978 | Callegari et al. | ..... | 414/22.63 |
| 4,306,634 | A * | 12/1981 | Sangster | ..... | 414/663 |
| 4,345,864 | A * | 8/1982 | Smith et al. | ..... | 414/22.63 |
| 4,759,414 | A * | 7/1988 | Willis | ..... | 175/170 |
| 4,765,401 | A * | 8/1988 | Boyadjieff | ..... | 166/77.53 |
| 5,160,238 | A * | 11/1992 | Kambara | ..... | 414/663 |
| 5,762,150 | A * | 6/1998 | Cheng et al. | ..... | 175/52 |
| 6,220,807 | B1 * | 4/2001 | Sorokan | ..... | 414/22.62 |
| 6,550,128 | B1 * | 4/2003 | Lorenz | ..... | 29/464 |
| 6,821,071 | B2 * | 11/2004 | Woolslayer et al. | ..... | 414/22.63 |
| 7,062,991 | B1 * | 6/2006 | West et al. | ..... | 81/57.16 |
| 7,246,983 | B2 * | 7/2007 | Zahn et al. | ..... | 414/22.65 |
| 7,311,489 | B2 * | 12/2007 | Ekman | ..... | 414/723 |
| 2008/0053704 | A1 * | 3/2008 | Zachariasen et al. | ..... | 175/52 |
| 2009/0053014 | A1 * | 2/2009 | Ge | ..... | 414/22.61 |
| 2010/0034620 | A1 * | 2/2010 | Orgeron | ..... | 414/22.55 |
| 2011/0247880 | A1 * | 10/2011 | Wrede et al. | ..... | 175/85 |
| 2012/0195716 | A1 * | 8/2012 | Nouwens et al. | ..... | 414/22.55 |

* cited by examiner

*Primary Examiner* — Saul Rodriguez
*Assistant Examiner* — Lynn Schwenning
(74) *Attorney, Agent, or Firm* — Lowenstein Sandler LLP

(57) ABSTRACT

A vertical pipe handler with pivoting arms for a drilling rig can include a central support and a central support center line. The vertical pipe hander can grab a tubular with top and bottom pipe grabbers, and lift the tubular using a bottom non-rotating collar and a bottom rack and bottom pinion lift mechanism. The tubular can be vertically positioned before being moved downward; thereby allowing for a next tubular in a series to be positioned and inserted.

13 Claims, 9 Drawing Sheets

VERTICAL PIPE HANDLER WITH PIVOTING ARMS AND SMART GRIP

FIELD

The present embodiments generally relate to a vertical pipe handler with pivoting arms and smart grip for a drilling rig.

BACKGROUND

A need exists for a vertical pipe handler that can grab and hold a tubular in position for engagement with a top drive.

A further need exists for vertical pipe handler that can be automated, thereby reducing the risk to drilling personnel.

A need exists for a pipe handler with remote controllable grips for automated handling of the entire tubular movement process.

The present embodiments meet these needs.

BRIEF DESCRIPTION OF THE DRAWINGS

The detailed description will be better understood in conjunction with the accompanying drawings as follows.

Figure 1A:
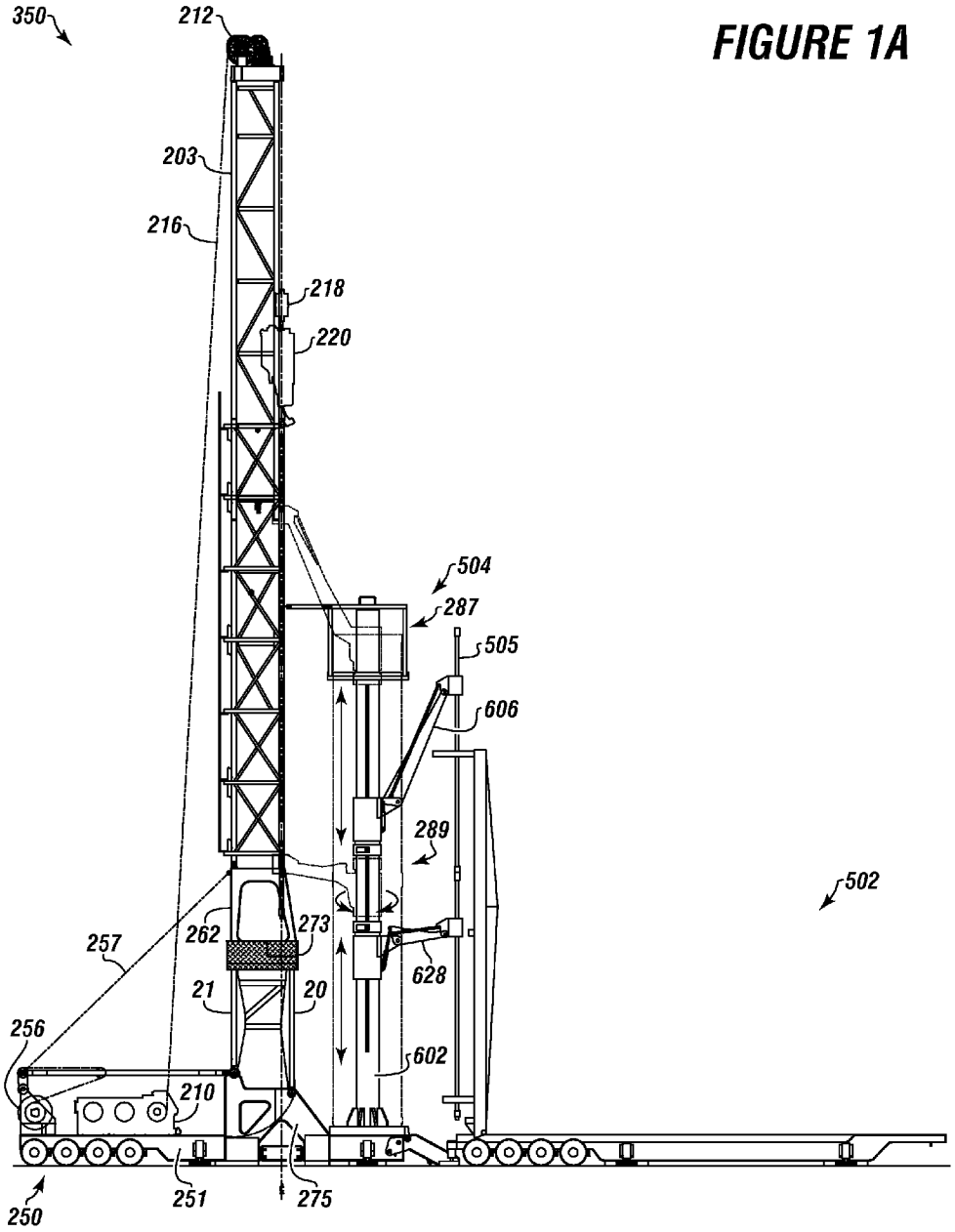
FIG. 1A depicts a drilling rig in a deployed position with the vertical pipe handler in a first position.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a vertical pipe handler with pivoting arms and smart grip for a drilling rig.

The present embodiments relate to a type of grip, herein referred to as "smart grip" for use with the pivoting arms of the vertical pipe handler.

A benefit of the vertical pipe handler is the device is capable of handling tubulars in wide ranges of diameter, from 2.27 inches to 20 inches.

Another benefit of this vertical pipe handler is the device facilitates drilling while making up joints simultaneously for offline stand building.

Yet another benefit of this vertical pipe handler is that allows for hands free operation, either mechanized, remotely, or fully automated.

Still another benefit is that the vertical pipe handler has a redundant motor arrangement to maintain operations even during motor failure.

The device has operational sequence and timing that eliminates the pipe handling equipment from critical path of drilling or tripping operations.

The vertical pipe handler has maximal power efficiency by sharing power units with other non-simultaneous rig operations.

Another benefit of the vertical pipe handler is that the installation is efficient and can be transported on top of a portable moveable horizontal to vertical pipe handler, thereby allowing transport of two units with only one trailer.

In an embodiment, the vertical pipe handler can include a central support with a central support center line, which can be mounted parallel to a drilling mast.

The vertical pipe handler can include a non-rotating top base collar, which can slidably move longitudinally on the central support and can be installed around the central support.

The vertical pipe handler can include a rotating top collar, which can be disposed over the non-rotating top base collar. The rotating top collar can provide a wide area of rotation, such as a rotating top collar that provides up to three hundred sixty degrees of rotation.

The vertical pipe handler can include a top pivoting arm, which can be connected to a rotating top collar pad eye of the rotating top collar. The top pivoting arm can be connected to a first pair of hydraulic cylinders. The first pair of hydraulic cylinders can each be double acting, single acting, or other commercially available cylinders.

The vertical pipe handler can include a top pipe grabber, which can be mounted to the top pivoting arm and can be used for grabbing and releasing tubulars. The top pipe grabber can be operated hydraulically.

The vertical pipe handler can include a top rack and top pinion lifting mechanism, which can be mounted to the non-rotating top base collar. The top rack can be fixed to the central support and the top pinion can be connected with the non-rotating top base collar.

The vertical pipe handler can include a top motor and drive gear, which can be used for a slew gear mechanism mounted to the non-rotating top base collar for rotating the rotating top collar.

The vertical pipe handler can include a bottom non-rotating collar, which can be mounted around the central support.

The vertical pipe handler can include a rotating bottom collar, which can include a bottom rotating collar pad eye. The bottom rotating collar pad eye can be mounted over the bottom non-rotating collar.

A bottom pivoting arm can be mounted to the bottom rotating collar pad eye.

The bottom pivoting arm can be connected to a second pair of hydraulic cylinders, which can apply force to the bottom pivoting arm. The second pair of hydraulic cylinders can each be double acting, single acting, or other commercially available cylinders.

The vertical pipe handler can include a bottom pipe grabber, which can open and close to hold the tubulars, such as to hold a tubular parallel to a longitudinal central support centerline of the central support. The bottom pipe grabber can be operated hydraulically.

The vertical pipe handler can include a bottom rack and bottom pinion lifting mechanism, with the bottom rack fixed to the central support and the bottom pinion connected with the bottom non-rotating collar.

The vertical pipe handler can include a bottom motor and a drive gear for a bottom slew gear mechanism, which can be mounted to the bottom non-rotating collar for rotating the rotating bottom collar.

The vertical pipe handler can grab tubulars with the top pipe grabber and the bottom pipe grabber.

The vertical pipe handler can lift the tubulars using the top non-rotating collar and top rack and top pinion lifting mechanisms. The vertical pipe handler can simultaneously rotate the rotating bottom collar and rotating top collar with slew gear mechanisms, which can present tubulars at a well center above a drill floor of a drilling rig.

The vertical pipe handler with pivoting arms can further include bottom pipe grabber pivot pins, bottom collar pivot pins, top pipe grabber pivot pins, and top collar pivot pins.

The central support can connect with the base, and the base can connect to a drill rig substructure.

The base can include one or more gussets for supporting the central support.

In one or more embodiments, the central support can be mounted through a drill floor, on the drill floor, or on a raised horizontal structure of the drill rig.

The vertical pipe handler can also include a racking board, which can be mounted to the central support, such as a racking board mounted opposite the base.

Figure 1B:
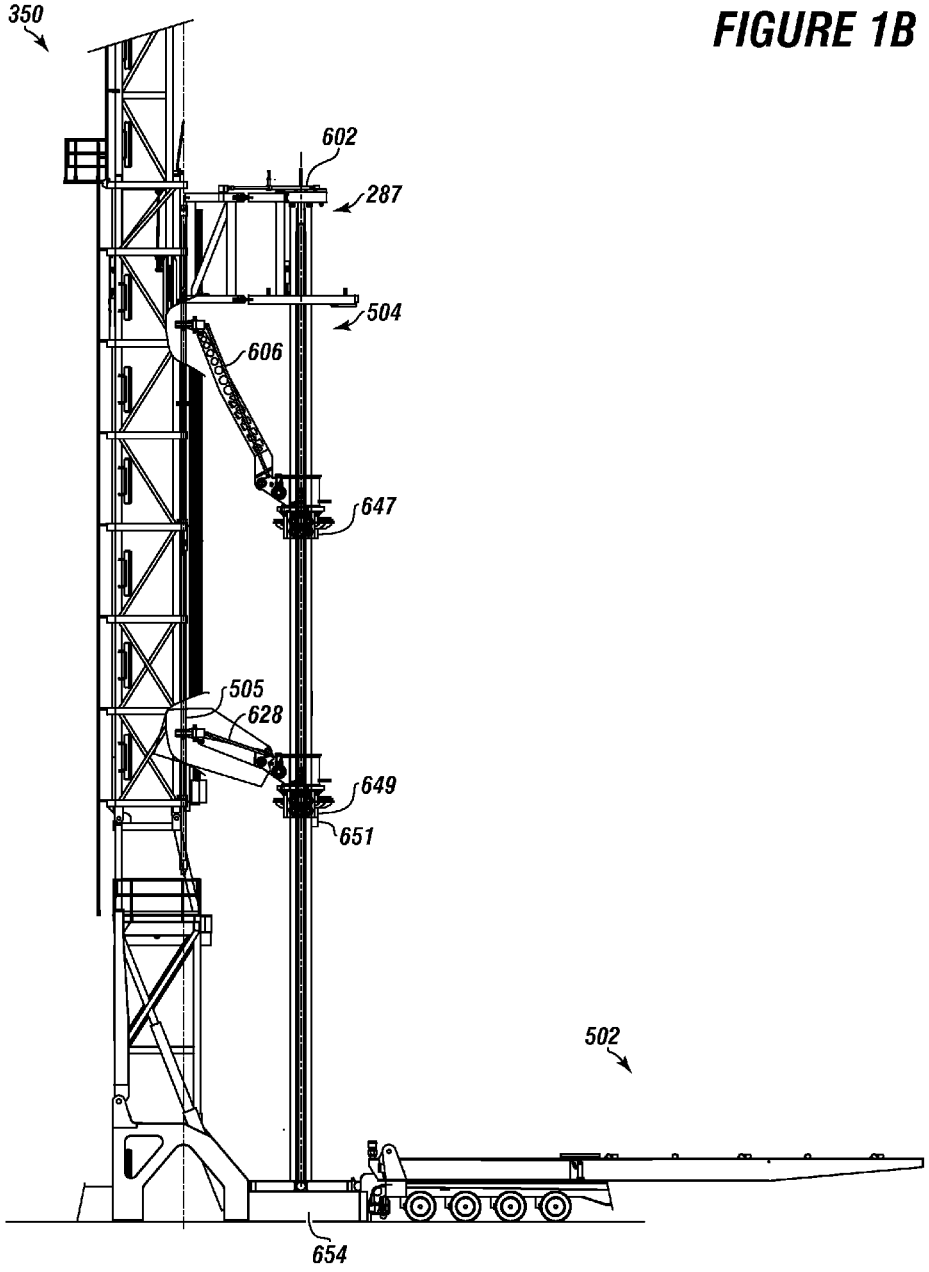
FIG. 1B depicts a drilling rig in a deployed position with the vertical pipe handler in a second position with the tubular.

Turning now to the Figures, FIGS. 1A and 1B show the rig system with the vertical pipe handler in two different positions.

FIG. 1A depicts a drilling rig in a deployed position with the vertical pipe handler in a first position grabbing a tubular from the portable moveable horizontal to vertical pipe handler.

The drilling rig 350 can have a mast 203. The mast can be pivotably connected to a subbase 262. The subbase 262 can be attached to a subbase trailer 250.

The subbase can have two legs 20, 21, which can be pivotably connected to a middle segment 275 fixed to a subbase trailer frame 251 of the subbase trailer 250, thereby allowing the mast 203 to be lowered from a vertical position to lie horizontally on the subbase trailer frame 251 for easy redeployment using a remote control button on the hydraulic control means.

The subbase can also support a drilling platform 273. The subbase can attach to a middle segment 275.

In embodiments, the vertical pipe handler 504 can be coupled to the middle segment 275 of the subbase 262 to prevent the machines from disengaging during operation.

The portable moveable horizontal to vertical pipe handler 502 can be removably coupled to the vertical pipe handler in embodiments.

The subbase trailer frame 251 can also non-removably support a winch 256.

The winch 256 can be used to wind and unwind a hoist line 257, which can be a wire, a cable, or other type of hoisting line, for supporting loads over 50 tons.

The hoisting line 257 is used to raise the mast 203 from a horizontal position for transporting the mast, to a vertical position used for operation of the rig or to lower the mast back to the subbase trailer frame for transport.

The subbase trailer frame of the drilling rig can support a drawworks 210.

A drill line 216 can run from the drawworks 210 to the top of the mast 203 through a crown block 212 at the top of the mast 203 to a traveling block 218 that can connect to a top drive 220.

The traveling block 218, like the top drive 220, can be configured to traverse one of the outer sides of the mast 203 as the top drive with traveling block is used to make up and break down drill pipe and other tubulars and to run the formed drill string into the wellbore.

The vertical pipe handler 504 can be used with a portable drilling rig having a single mast, with a portable drilling rig having telescoping masts, and the like.

The vertical pipe handler 504 can be used with land based drilling rigs as shown, or with offshore rigs, being bolted directly to the drill floor of the offshore rig in a non-removable embodiment.

The vertical pipe handler 504 can lift pipe from a barge along an offshore drilling rig.

The vertical pipe handler 504 can be used on work over drilling rigs or on FPSO and J-lay pipe laying boats.

The vertical pipe handler 504 can have pivoting arms in a position to receive pipe from a portable moveable horizontal to vertical pipe handler 502.

The portable moveable horizontal to vertical pipe handler 502 can be positioned adjacent to a vertical pipe handler 504.

Figure 2:
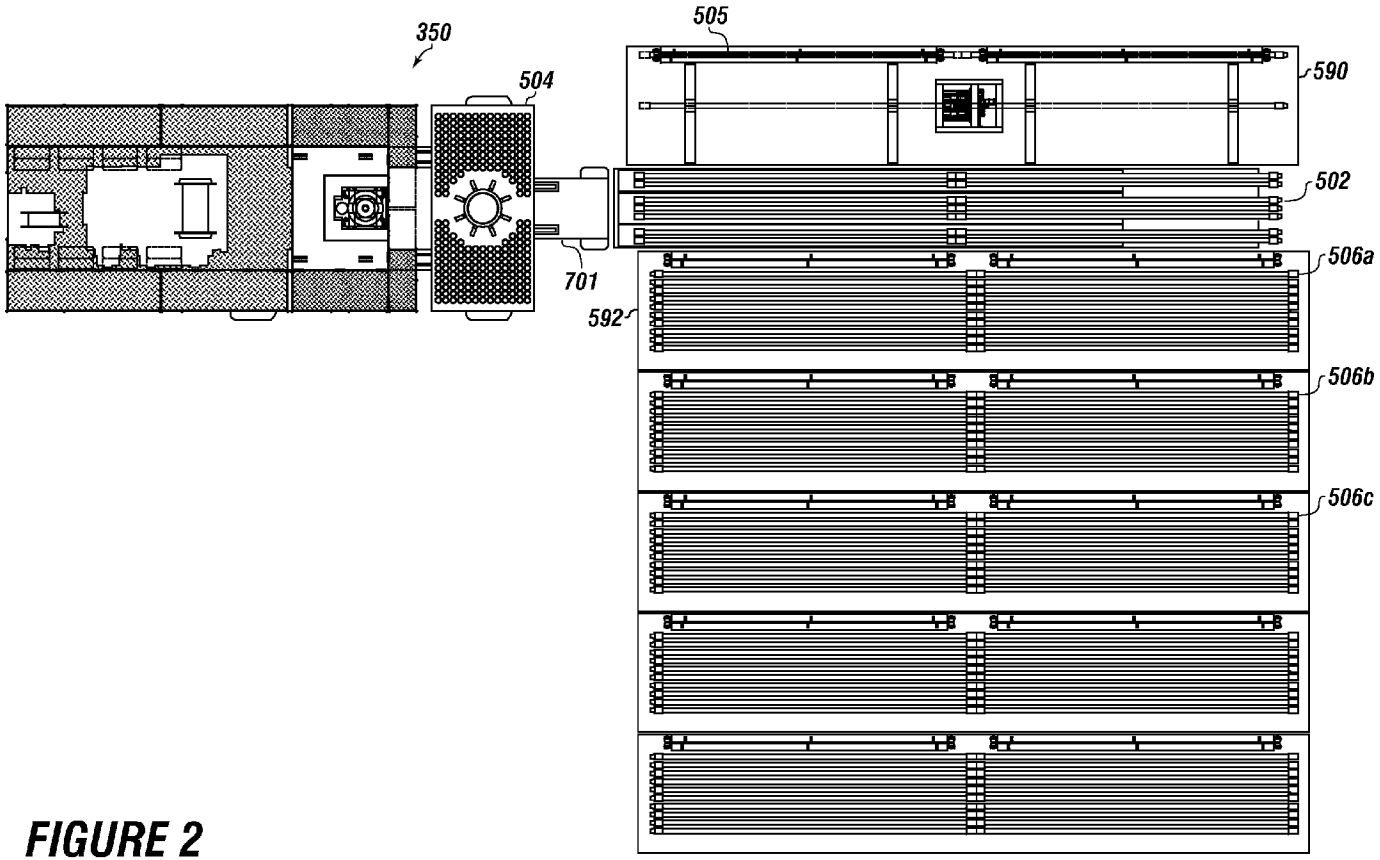
FIG. 2 depicts a top view of the drilling rig in the deployed position.

The portable moveable horizontal to vertical pipe handler 502 is shown as a trailer mounted device that can grab a tubular from a horizontal position. The tubular can be disposed in horizontal positions in a pipe tub 592, in a cassette of pipes, or in a bucking machine 590 as shown in FIG. 2.

The top pivoting arm 606 and bottom pivoting arm 628 of the vertical pipe handler 504 are depicted grabbing a tubular 505 from the portable moveable horizontal to vertical pipe handler 502.

The top portion 287 of the central support 602 and mid-portion 289 of the central support 602 are also shown.

FIG. 1B depicts a drilling rig in a deployed position with the vertical pipe handler in a second position with the tubular.

The Figure shows the top pivoting arm 606 and the bottom pivoting arm 628 of the vertical pipe handler 504 placing the tubular 505 for attachment to a drill string of a drilling rig 350.

The vertical pipe handler 504 can be attached to a vertical pipe handler base 629.

The vertical pipe handler can move a tubular 505, which can be a drill pipe or similar material usable the wellbore.

The top and bottom pivoting arms 606 and 628 can grab a tubular one at a time or grab multiple tubulars simultaneously.

The top and bottom pivoting arms 606 and 628, using hydraulic motors, can rotate around a central support 602 using a master control system 651 or individual controllers for each arm.

The top and bottom pivoting arms 606 and 628 can rotate 200 degrees clockwise from well center and 160 degrees counter clockwise from well center around the central support, to move the tubular from a portable moveable horizontal to vertical pipe handler 502 to connect to a top drive at the well center.

In one or more embodiments, the pivoting arms can rotate the same amount of degrees.

In one or more embodiments, the arms can rotate 360 degrees.

The top and bottom pivoting arms 606 and 628 can move from the top portion 287 of the central support 602 to a mid-portion 289 of the central support 602 using the hydraulic power unit as shown in FIG. 1A.

In embodiments, the top and bottom pivoting arms can move from within a few feet of the top of the central support to within a few feet of the base of the central support.

The vertical pipe handler can be used for both pipe make up and forming drill string and for pipe break out and breaking down of a drill string.

In embodiments, each pivoting arm can move simultaneously and synchronously with the other pivoting arm, in the same direction of rotation, such as clockwise or counter clockwise, to the same degree stopping point and the same height up or down the column, such as to a height of 27.325 feet or to a height of 67.2 feet.

The vertical pipe handler can grab the tubular that has been moved through a ninety degree arc from a horizontal position parallel to the ground or drill floor to a vertical position such as 90 degrees from the horizontal position by the horizontal to vertical pipe handler.

The vertical pipe handler 504 can have a top pivoting arm 606 adjacent a top portion 287 for positioning the tubular 505 for connection with a top drive on one end and a drill string on the other end.

The top pivoting arm 606 can have a first independently controllable hydraulic power system 647, and the bottom pivoting arm 628 can have a second independently controllable hydraulic power system 649.

In one or more embodiments, the master control system 651 can operate the pivoting arms independently or synchronously.

The master control system can include a processor with computer instructions that can be communicated through a computing cloud or a network to the hydraulic power systems of the pivoting arms.

The pivoting arms each have clamps that open and close on the tubular and can be operated by the master control system 651 or by a local remote control.

FIG. 2 shows the vertical pipe handler 504 connected to the drilling rig 350 on one side and operationally connected to a bucking machine 590 containing a tubular 505 and, a pipe tub 592 containing tubulars 506*a*, 506*b*, and 506*c*. The portable moveable horizontal to vertical pipe handler can pull tubulars for one or both of these devices simultaneously.

The portable moveable horizontal to vertical pipe hander 502 can connect with a substructure connector 701.

Figure 3A:
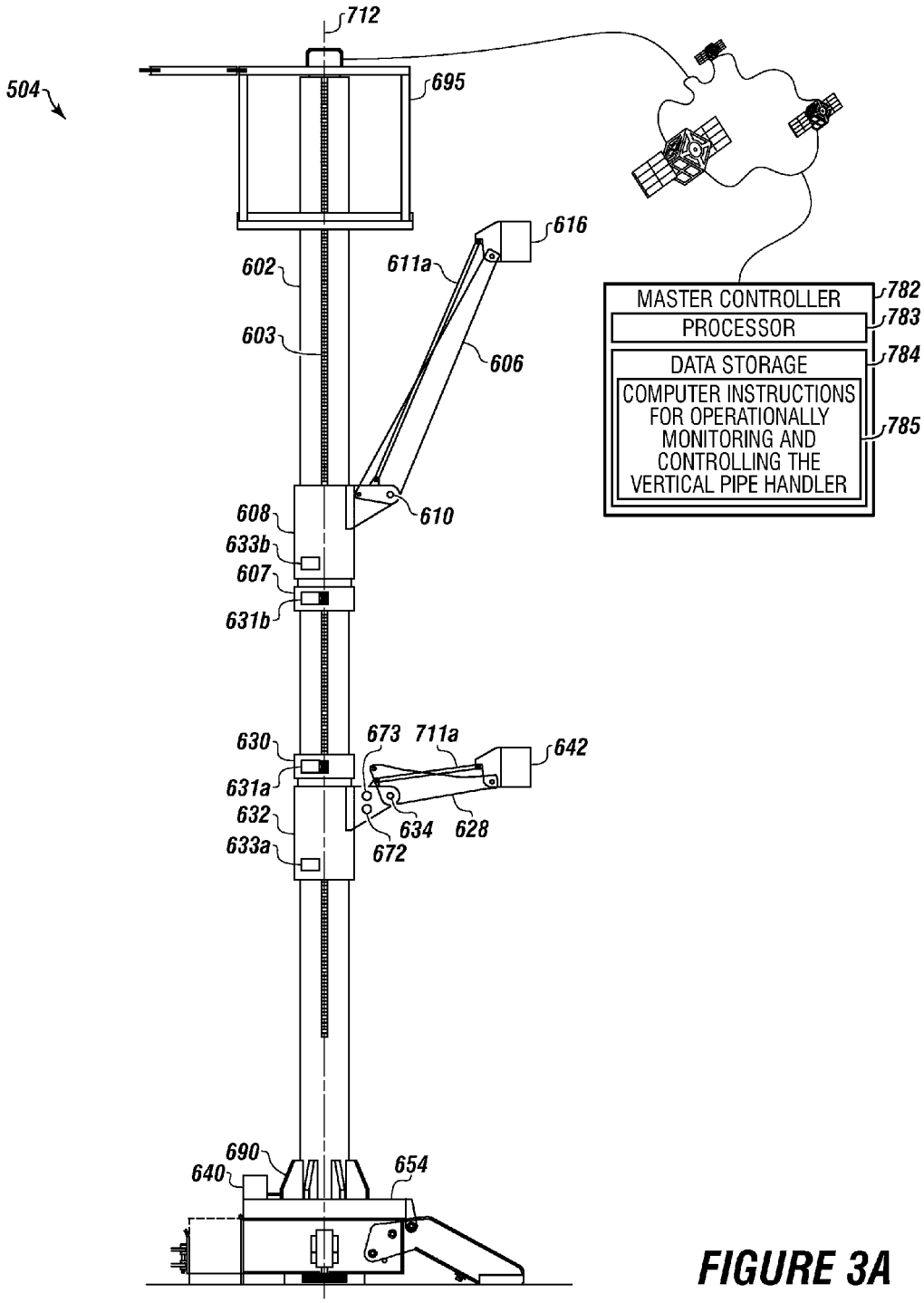
FIG. 3A depicts a side view of the vertical pipe handler with pivoting arms for the drilling rig.

FIG. 3A depicts a side view of the vertical pipe handler 504 that can have a central support 602, and top and bottom pivoting arms 606 and 628 attached to the central support with rotating bottom and top collars respectively, that can be used in making up a drill string or breaking down a drill string for a land based or offshore oil or natural gas drilling rig.

The central support can be supported by a base 654 that can have gussets 690.

The vertical pipe handler 504 can have a top pivoting arm 606 and a bottom pivoting arm 628.

The central support 602 can have a central support rack 603.

A non-rotating top base collar 607 can be disposed about the central support 602. The non-rotating top base collar 607 can move longitudinally on the central support 602.

The non-rotating top base collar 607 can have a motor assembly 631*b* to interact with the central support rack 603 on the central support 602.

A rotating top base collar 608 can be disposed over the non-rotating top base collar 607. The rotating top base collar 608 can provide up to 360 degrees of rotation.

The rotating top base collar 608 can have a rotating top collar pad eye 610 connected with the top pivoting arm 606 such as with a fastener.

The rotating top base collar 608 can be rotated by a top slew gear mechanism. The top slew gear mechanism can include a top motor and drive gear 633*b*. The top slew gear mechanism can be mounted to the non-rotating top base collar 607.

A pair of control bars can be used to control the extension and retraction of the arm. In this figure, control bar 611*a* can be seen connected to the top pipe grabber 616.

The rotating top base collar 608 can be rotated by a slew gear mechanism connected with the non-rotating top base collar 607. The slew gear mechanism can include a motor and drive gear.

A top pipe grabber 616 can be connected with the top pivoting arm 606. The top pipe grabber 616 can be configured to grab and release a tubular.

The top pipe grabber can be a smart grip as shown in FIGS. 4-8.

The vertical pipe handler 504 can also include a bottom non-rotating collar 630 mounted around the central support 602.

A rotating bottom collar 632 can include a bottom rotating collar pad eye 634. The rotating bottom collar 632 can be disposed about the bottom non-rotating collar 630.

The bottom pivoting arm 628 can be mounted to the bottom rotating collar pad eye 634, such as with a fastener.

A pair of control bars can be used with the bottom pipe grabber 642. Control bar 711*a* is shown in the Figure.

A bottom pipe grabber 642 can be located on the bottom pivoting arm 628 and can be configured to grab and hold a tubular parallel to a longitudinal axis 712 of the central support 602.

The bottom pipe grabber 642 can be a smart grip as shown in FIGS. 4-8.

A motor assembly 631*a* can be connected with the bottom non-rotating collar 630. The bottom motor assembly like the top motor assembly allows the non-rotating collars to move up and down the longitudinal axis 712 of the central support.

The rotating bottom collar 632 can be rotated by a bottom slew gear mechanism.

The bottom slew gear mechanism can include a rotating motion motor assembly 633*a* for rotating each of the rotating collars around the central support using the hydraulic power unit 640. The bottom slew gear mechanism can be mounted to the bottom non-rotating collar 630.

The motor assemblies 631*a*, 631*b* can be used for vertically raising and lowering each non-rotating collar. The vertical motion motor assemblies engage the central support rack and the hydraulic power supply.

A racking board 695 can be disposed about the central support 602.

Also shown are the bottom extension motors 672 and 673.

A master controller 782 can communicate with the vertical pipe handler. The master controller can have a processor 783 and a data storage 784 which can contain computer instructions for operationally monitoring and controlling the vertical pipe handler 785. The master controller can be connected to a network. The master controller can be partially disposed in a computing cloud for worldwide usage of the computer instructions.

Figure 3B:
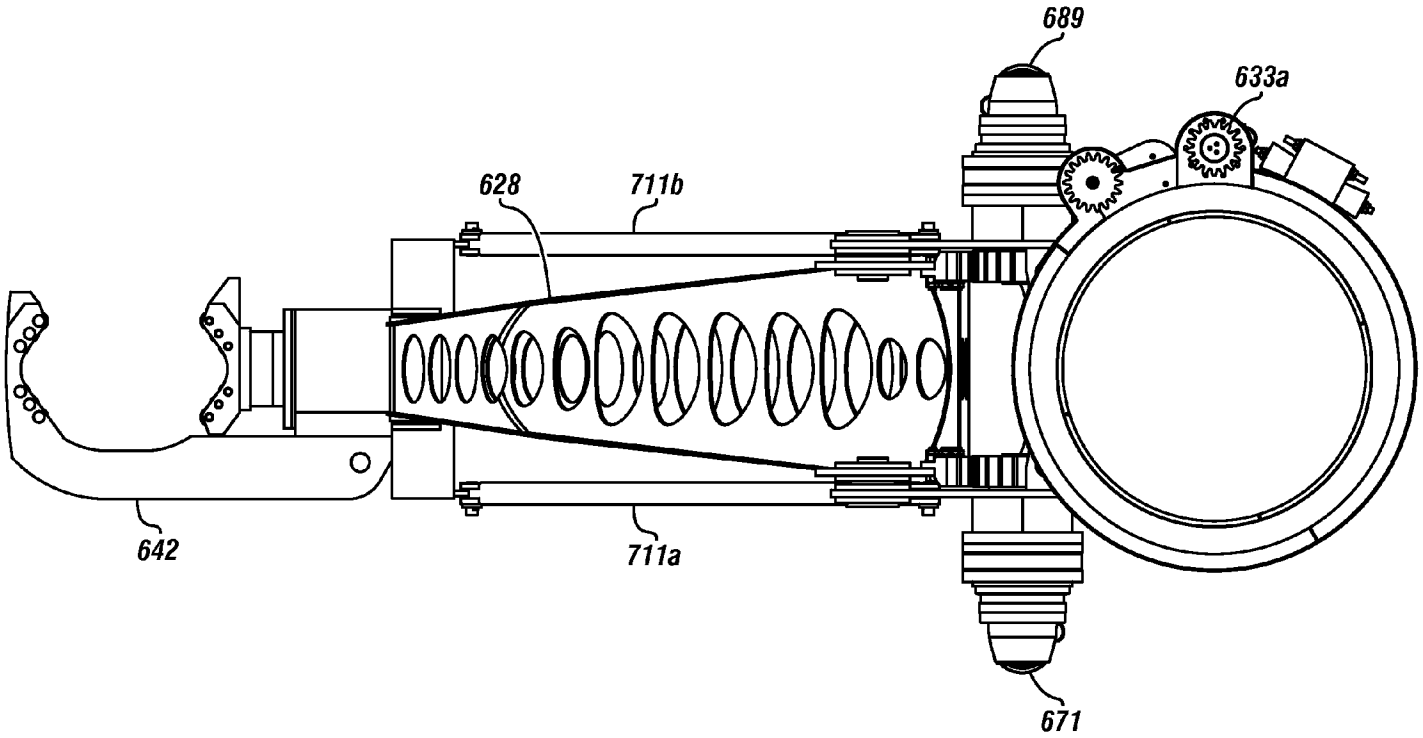
FIG. 3B is a bottom view of the top pivoting arm.

FIG. 3B is a bottom view of the bottom pivoting arm 628.

A plurality of pivoting arm motors can be connected to the bottom pivoting arm. Similar pivoting motors can connect to the top pivoting arm.

One of the pivoting arm motors 633*a* that can rotate the bottom pivoting arm around the central support is shown.

A first extension motor 689 can be opposite a second extension motor 671. The extension motors 689, 671 can be used to extend and retract the bottom pivoting arm away from and back to the central support. Similar extension motors can be connected to the top pivoting arm.

The bottom pivoting arm can have a pair of control bars 711*a*, 711*b*. The pair of control bars can be used to control the extension and retraction of the bottom pivoting arm and can be connected to the hydraulic power unit.

The top pivoting arm can also have a pair of control bars connected to the hydraulic power unit.

The bottom pivoting arm can have a bottom pipe grabber 642.

Figure 4:
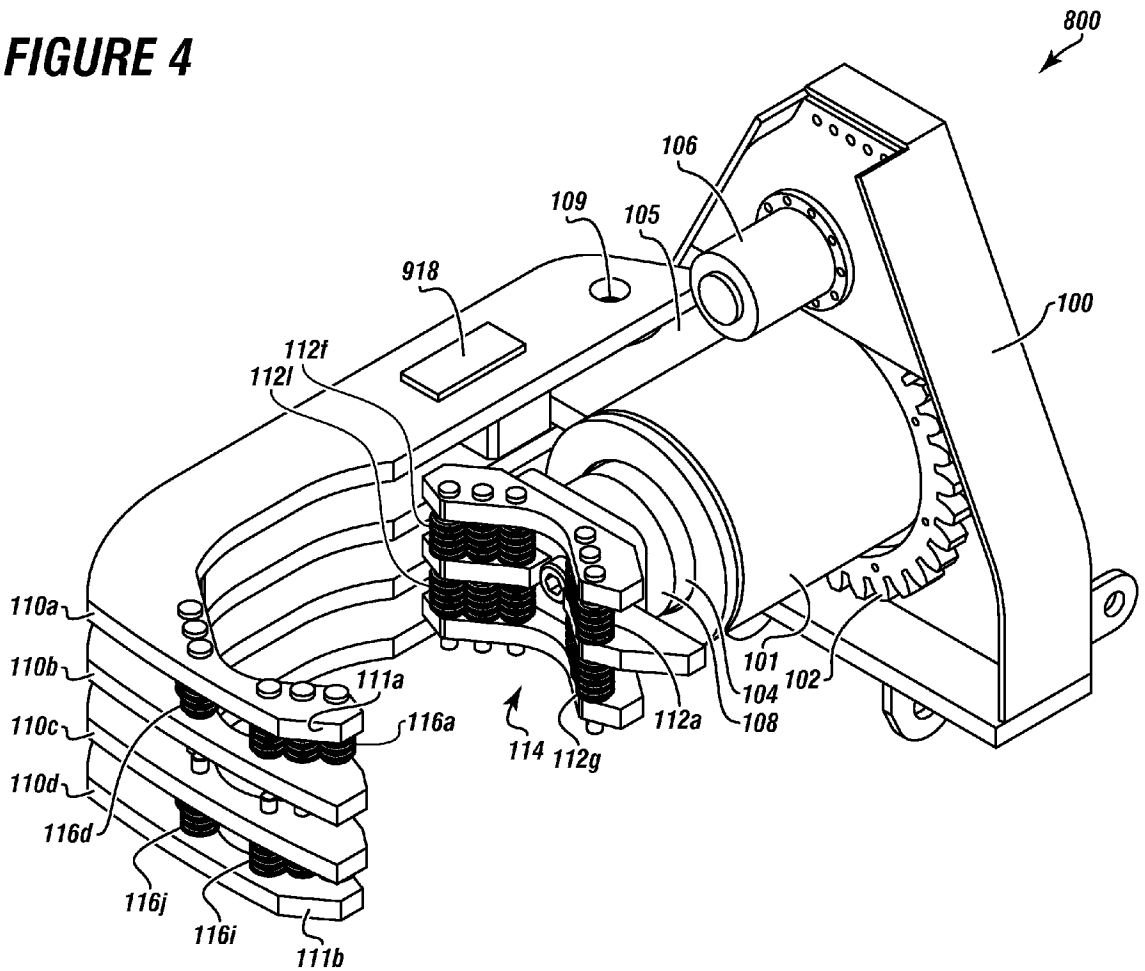
FIG. 4 depicts a perspective view of the smart grip for grabbing tubulars.

FIG. 4 is a perspective view of the smart grip that can be used in embodiments of the vertical pipe handler.

The smart grip 800 can have a gripper finger base 100 that can support a motor 106 and a slew gear 102.

A hydraulic cylinder 101 can be attached to the slew gear 102 for hydraulically pushing a piston 104 into and out of the hydraulic cylinder.

A connection sleeve 108 can connect the piston 104 to a gripper palm 114, which can have several different embodiments, as shown in subsequent Figures.

Fingers 110*a*, 11*b*, 110*c* and 110*d* can attach to the hydraulic cylinder 101 to allow the fingers to be rotated from twenty degrees to one hundred eighty degrees around the hydraulic cylinder, and can rotate one hundred eighty degrees within one second.

Between each finger pair, on the side of the fingers opposite the connection to the hydraulic cylinder are gripper finger roller assemblies 116*a*-116*d* and 116*i*-116*j*.

Disposed opposite the gripper finger roller assemblies are palm gripper roller assemblies 112*a*-112*f* and 112*g*-1121.

The gripper palm roller assemblies and gripper finger roller assemblies can each engage opposite sides of a tubular when the gripper palm is pushed against the tubular using the piston 104.

In embodiments, the fingers 110*a*-110*d* can be connected to the hydraulic cylinder using a piston pad eye 105 and a pin 109.

In embodiments two of the fingers on the ends opposite the hydraulic cylinder can have a bevel 111*a* and 111*b*.

FIG. 4 also shows a vertical pipe handler monitoring device 918 that can monitor the presence of each tubular and monitor pressure applied to a tubular connected to the vertical pipe handler and the master controller.

Figure 5:
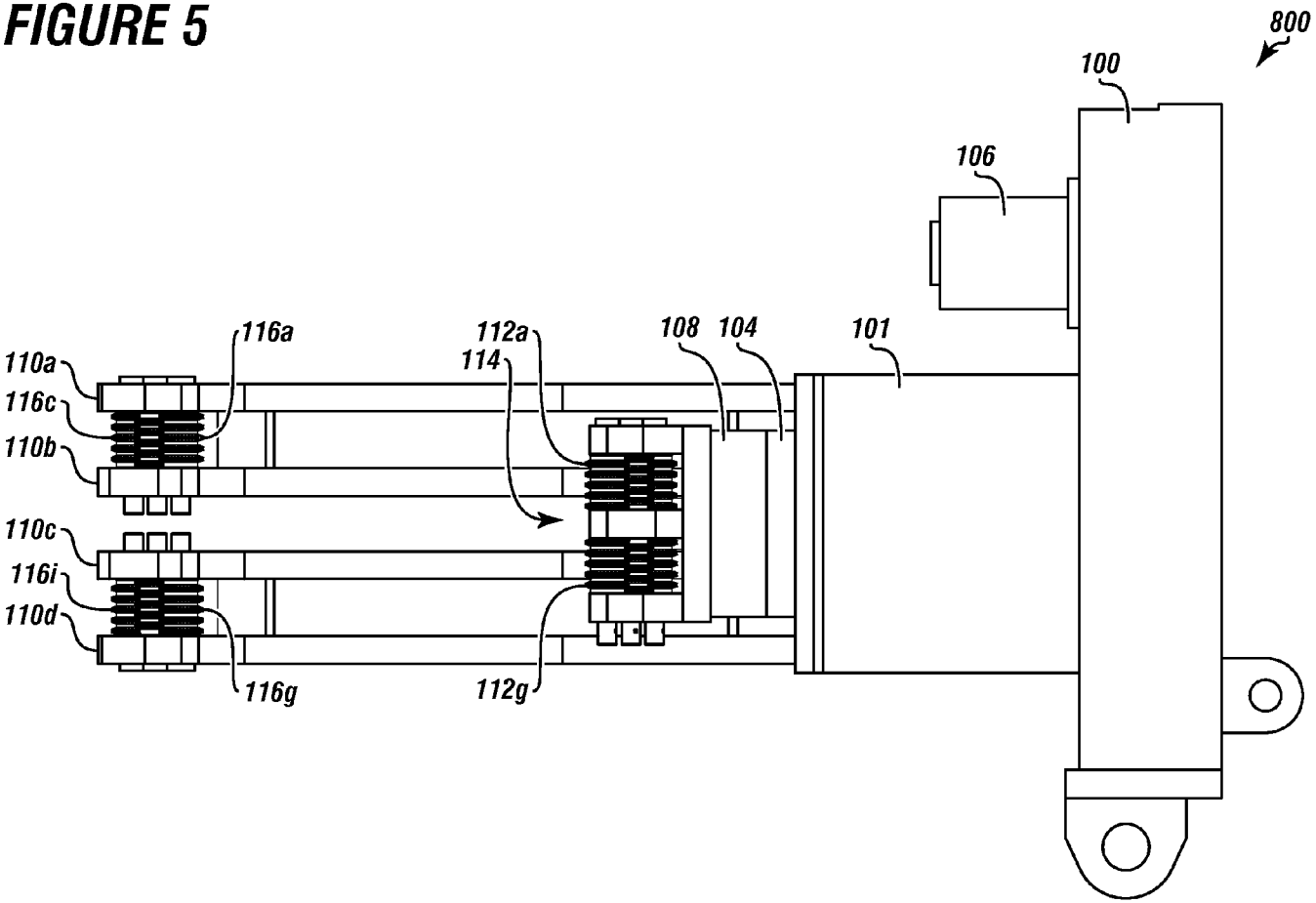
FIG. 5 is a bottom view of the smart grip of FIG. 4.

FIG. 5 is a bottom view of the smart grip 800.

The gripper finger base 100 can be attached to a hydraulic motor 106.

The fingers 110*a*, 110*b*, 110*c*, and 110*d* can be plates of steel.

Gripper finger roller assemblies 116*a*-166*c* and 116*g*-116*i* can be located between the fingers.

The gripper palm 114 can have gripper palm roller assemblies 112*a*-112*g* secured thereto.

The hydraulic cylinder 101 can be connected to a piston 104 extending therefrom and having a connection sleeve 108 connected to the piston for extending the gripper palm 114 as needed to grab a tubular. The piston can also retract, allowing the smart grip to release the tubular by remote control.

Figure 7:
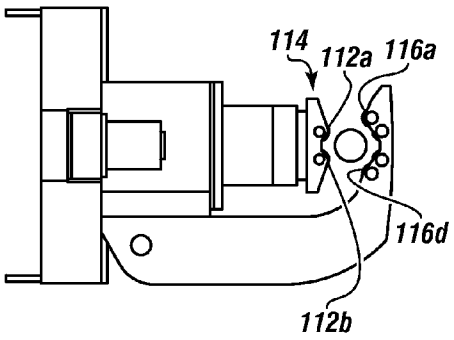
FIG. 7 is a top view of a different embodiment of the smart grip.
Figure 8:
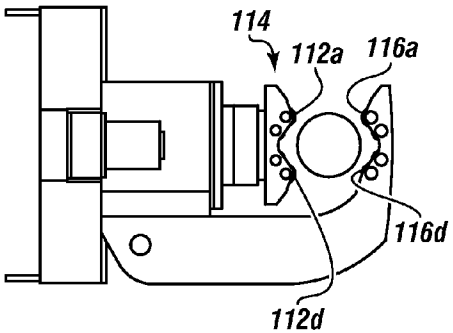
FIG. 8 is a top view of another different embodiment of the smart grip.
Figure 6:
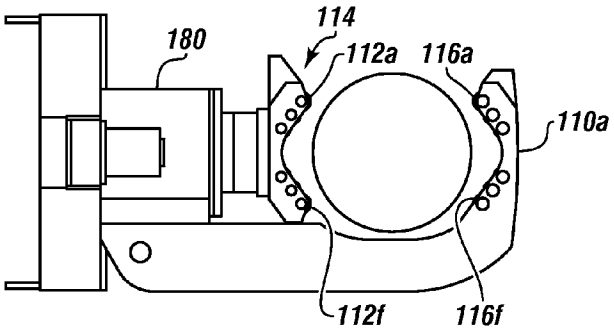
FIG. 6 is a top view of the smart grip with another palm embodiment.

FIGS. 6-8 show that the smart grip can accommodate different diameter tubulars with interchangeable gripper palms. Also, these Figures show that different numbers of roller assemblies can be used on the gripper palm and fingers of the smart grip.

FIG. 6 shows a side view of the smart grip with gripper palm 114 having six gripper palm roller assemblies 112*a*-112*f* and twelve gripper finger roller assemblies positioned between the fingers opposite the gripper palm 114. Finger 110*a* and gripper finger roller assemblies 116*a*-116*f* are shown.

FIG. 7 shows a side view of the smart grip with gripper palm 114 having two gripper palm roller assemblies 112*a*-112*b*, and eight gripper finger roller assemblies positioned between fingers opposite the gripper palm 114. Gripper finger roller assemblies 116*a*-116*d* are shown.

FIG. 8 shows a side view of the smart grip with gripper palm 114 having four gripper palm roller assemblies 112*a*-112*d* and four gripper finger roller assemblies 116*a*-116*d* positioned between fingers opposite the gripper palm 114.

The roller assemblies can be made from plastic rods, rollers, steel, rubber, bronze or combinations thereof for allowing the tubular to non-deformably engage with the smart grip.

Figure 9:
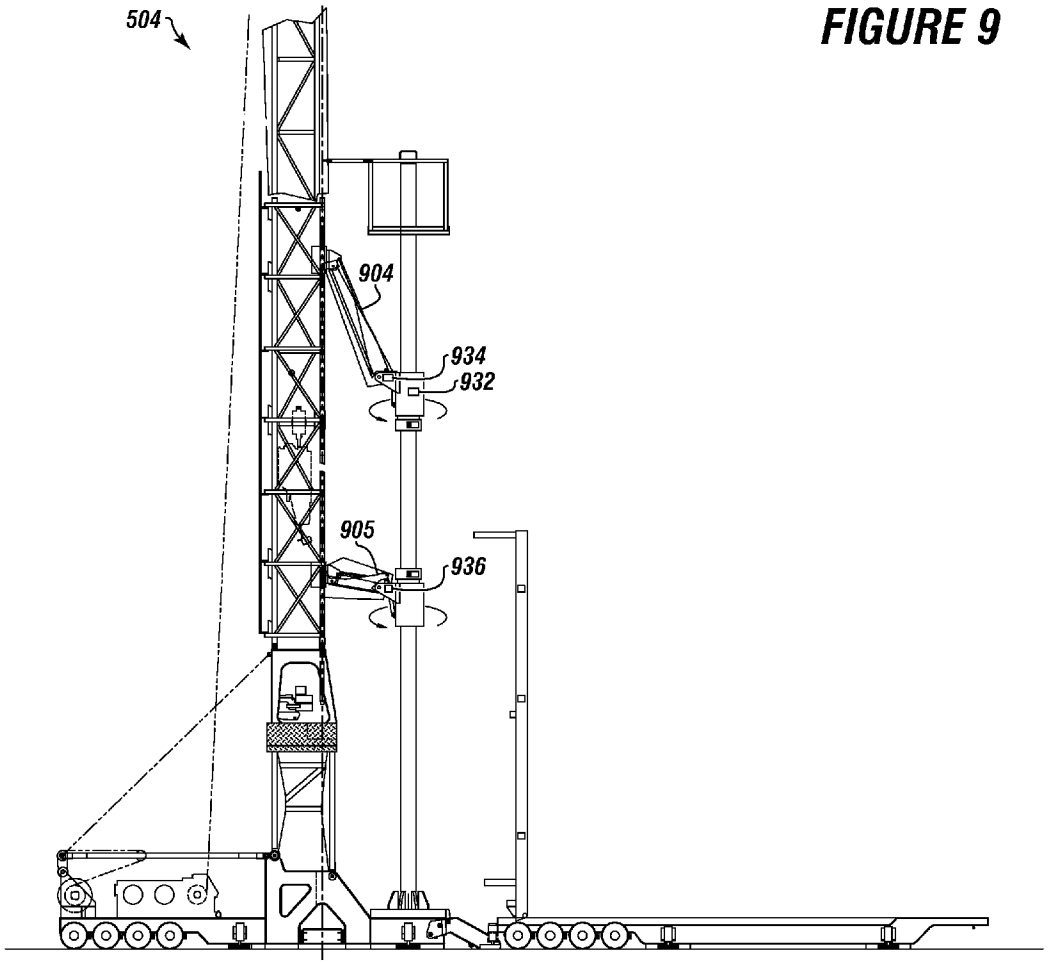
FIG. 9 is a side view of another embodiment of the vertical pipe handler.

FIG. 9 shows another embodiment of the vertical pipe handler 504.

The vertical pipe handler 504 can have a vertical pipe handler rotation and vertical motion monitor 932. The vertical pipe handler rotation and vertical motion monitor 932 can transmit a signal to the master controller indicating a degree at which the vertical pipe handler is positioned and a height at which either the top pivoting arm 904, the bottom pivoting arm 905, or both, are located from a base of the vertical pipe handler.

The top pivoting arm can have a first arm monitor 934 and the bottom pivoting arm can have a second arm monitor 936 which can communicate with the master controller to determine an angle of extension of each pivoting arm on a vertical pipe handler and transmit the angle of extension to the server.

While these embodiments have been described with emphasis on the embodiments, it should be understood that within the scope of the appended claims, the embodiments might be practiced other than as specifically described herein.

What is claimed is:

1. A vertical pipe handler for placing and holding tubulars to make up and break out a drill string for a drilling rig comprising:

a. a central support;

b. a non-rotating top base collar for moving longitudinally on the central support, wherein the non-rotating top base collar is installed around the central support;

c. a rotating top collar disposed over the non-rotating top base collar providing rotation;

d. a top pivoting arm connected to the rotating top collar, wherein the top pivoting arm is connected to a hydraulic power unit;

e. a top pipe grabber mounted to the top pivoting arm for grabbing and releasing a tubular, the top pipe grabber being connected to a pair of first control bars and connected to the hydraulic power unit, wherein the top pipe grabber is configured to orient the tubular parallel to a longitudinal axis of the central support;

f. a bottom non-rotating collar installed around the central support;

g. a rotating bottom collar disposed over the bottom non-rotating collar providing rotation;

h. a bottom pivoting arm, wherein the bottom pivoting arm is connected to the hydraulic power unit;

i. a plurality of pivoting arm motors connected to the top pivoting arm, the bottom pivoting arm, and the hydraulic power unit for rotating the top pivoting arm and the bottom pivoting arm about the central support;

j. a plurality of extension motors for extending and retracting the top pivoting arm and the bottom pivoting arm away from and back to the central support;

k. a bottom pipe grabber mounted to the bottom pivoting arm for grabbing and releasing the tubular, the bottom pipe grabber being connected to a pair of second control bars and connected to the hydraulic power unit, wherein the bottom pipe grabber is configured to orient the tubular parallel to the longitudinal axis of the central support;

l. a rotating motion motor assembly for rotating each of the rotating top collar and rotating bottom collar around the central support using the hydraulic power unit;

m. a plurality of motor assemblies for vertically raising and lowering the non-rotating top base collar and the bottom non-rotating collar, wherein the plurality of motor assemblies are connected to the hydraulic power unit; and n. a master controller comprising a processor and a data storage, the data storage containing computer instructions for operationally monitoring and controlling the vertical pipe handler, wherein the master controller is in communication with the vertical pipe handler.

2. The vertical pipe handler of claim 1, further comprising a vertical pipe handler rotation and vertical motion monitor for indicating a degree at which the vertical pipe handler is positioned and a height at which either the top pivoting arm, the bottom pivoting arm, or both, are located from a base of the vertical pipe handler.

3. The vertical pipe handler of claim 1, further comprising a first arm monitor and a second arm monitor in communication with the master controller to determine an angle of extension of the top pivoting arm and the bottom pivoting arm of a vertical pipe handler and transmit the angle of extension to the server.

4. The vertical pipe handler of claim 1, further comprising a vertical pipe handler monitoring device that can monitor the presence of the tubular and a pressure applied to the tubular connected to the vertical pipe handler and the master controller.

5. The vertical pipe handler with pivoting arms of claim 1, wherein the central support is supported by a base.

6. The vertical pipe handler of claim 2, wherein the base connects to a drill rig substructure.

7. The vertical pipe handler of claim 2, wherein the base further comprises base gussets for providing stability and strength to the central support.

8. The vertical pipe handler of claim 1, wherein the top pipe grabber and the bottom pipe grabber open and close hydraulically.

9. The vertical pipe handler of claim 1, wherein a racking board is disposed about the central support.

10. The vertical pipe handler of claim 1, wherein the top pipe grabber, or the bottom pipe grabber, or both are a smart grip, wherein the smart grip comprises:

a. a gripper finger base that supports a motor and a slew gear;

b. a rotating hydraulic cylinder connected to the slew gear;

c. a piston for deploying from and retracting into the rotating hydraulic cylinder;

d. a gripper palm connected to the piston;

e. a plurality of fingers attached to the rotating hydraulic cylinder, wherein the rotating hydraulic cylinder can rotate the attached plurality of fingers from twenty zero degrees to one hundred eighty degrees; and f. gripper palm roller assemblies disposed opposite gripper finger roller assemblies contained between each pair of fingers of the plurality of fingers that allow the gripper palm and the plurality of fingers to engage opposite sides of a tubular when the gripper palm is pushed against the tubular using the piston.

11. The vertical pipe handler of claim 1, further comprising a central support rack disposed in the central support allowing travel by the top non-rotating collar and bottom non rotating collar synchronously from a base to a top of the central support using rack and pinion motion.

12. The vertical pipe handler of claim 1, wherein each pivoting arm is hinged around pad eyes.

13. The vertical pipe handler of claim 10, wherein the plurality of fingers each have a bevel allowing the plurality of fingers to fit into a racking board.

* * * * *